United States Patent [19]

Warner

[11] 3,976,551

[45] Aug. 24, 1976

[54] METHOD FOR REDUCING THE SULFUR CONTENT OF A PETROLEUM FRACTION

[75] Inventor: Paul F. Warner, Phillips, Tex.

[73] Assignee: Phillips Petroleum Company, Bartlesville, Okla.

[22] Filed: Nov. 11, 1974

[21] Appl. No.: 522,604

Related U.S. Application Data

[62] Division of Ser. No. 150,815, June 7, 1971, Pat. No. 3,865,714.

[52] U.S. Cl. ..... 204/158 R; 204/162 R

[51] Int. Cl.[2] ..... B01J 1/10

[58] Field of Search ..... 204/158 R, 162; 208/238

[56] References Cited

UNITED STATES PATENTS

| | | | |
|---|---|---|---|
| 2,392,294 | 1/1946 | Rust et al. | 204/158 R |
| 2,763,593 | 9/1956 | Leesemann | 204/158 R |
| 3,338,810 | 8/1967 | Warner | 204/159.18 |
| 3,340,184 | 9/1967 | Eng et al. | 208/238 |

*Primary Examiner*—Howard S. Williams

[57] ABSTRACT

A method for reducing the sulfur content of a volume of petroleum fraction having a distillation end point below about 600°F. and containing mercaptans by contacting the petroleum fraction with an unsaturated polymer, subjecting the resultant mixture to one of an ultraviolet light wave, a fluorescent light wave or a catalyst and separating the petroleum fraction from the polymer having the alkyl sulfides attached thereto.

8 Claims, No Drawings

METHOD FOR REDUCING THE SULFUR CONTENT OF A PETROLEUM FRACTION

This application is a division application of Ser. No. 150,815, filed June 7, 1971, now U.S. Pat. No. 3,865,714.

It is desirable to reduce the sulfur content of a petroleum fraction for numerous reasons, one of which is that the sulfur in the petroleum fraction is corrosive in nature, resulting in detrimentally affecting equipment with which it comes in contact. One form in which sulfur is present in petroleum fractions and in which form the sulfur is particularly corrosive is where said sulfur resides as mercaptans.

The invention, therefore, resides in a method for reducing the sulfur content of a volume of petroleum fraction having a distillation end point below about 600°F. and containing mercaptans by contacting the petroleum fraction with an unsaturated polymer and separating the petroleum fraction from the polymer.

In a method of this invention, the petroleum fraction can be, for example, gasoline, kerosene, liquefied petroleum gas, and jet fuel, among others which have distillation end points below about 600°F. and which contain mercaptans.

This petroleum fraction is brought into contact with an unsaturated polymer by adding and mixing one with the other. The unsaturated polymer can be a polymer of a conjugated diene, a copolymer of a conjugated diene with vinyl aromatic compounds or mixtures thereof. Examples of these polymers are polybutadiene, polymers of isoprene, 2,3-dimethyl-1,3-butadiene, chloroprene or mixtures one with the other or mixtures with other vinyl aromatic compounds such as, for example, styrene, vinylpyridine, 2-methyl-5-vinylpyridine, methyl styrene, vinyl naphthalene, or mixtures thereof. It is preferred, however, that polybutadiene be utilized as the polymer owing to its readily availability, ease in handling, and effectiveness in reducing the sulfur content of the petroleum fraction.

The amount of polymer is dependent upon the sulfur content of the petroleum fraction, the amount of sulfur content desired to be removed, and the polymer or polymer mixture utilized. The amount of polymer can be determined by analysis and calculations by one skilled in the art. For example, stoichiometrically, 54 g. of polybutadiene is capable of reacting with about (0.8) (32 g.) of mercaptan sulfur or 25.6 g. where the polybutadiene is about 80 percent unsaturated.

In maintaining a desired efficiency of the method of this invention, it is preferred that the added polymer have at least 30 double bonds per molecule, the polymer be added in liquid form with said liquid having a viscosity in the range of about 100–6000 Saybolt Seconds at 100°F., and the polymer have an average molecular weight in the range of about 1000–3000. Although the method of this invention can be practiced without limiting the polymer to the preferred characteristics as set forth above, where polymers having characteristics outside of the preferred limitations are utilized, the efficiency of the process is decreased.

The mixture of the petroleum fraction and the polymer is thereafter subjected to one of an ultraviolet light wave, a fluorescent light wave, or a catalyst. It is believed that this causes the conversion of the mercaptan of the petroleum fraction to alkyl sulfides and attaches said alkyl sulfides to the polymer. The methods by which the mixture is contacted with the light waves or catalyst can be varied and are known in the art.

A light source for irradiating the mixture by the method of this invention with ultraviolet light waves is, for example, by artificial means such as a 450-watt Hanovia mercury vapor UV lamp (type 54A36) or a 100-watt mercury vapor bulb, preferably ultraviolet sources having wave lengths below about 2900 Angstroms. Sources having wave lengths in the range of about 100 to about 3800 Angstroms can be used.

A light source for irradiating the mixture by the method of this invention with fluorescent light waves is, for example, a fluorescent lamp that is coated on its inner surface with a phosphorus and contains mercury vapor that is bombarded by electrons from a cathode.

Catalysts for effecting the conversion of the mercaptans of the mixture by the method of this invention are, for example: hydrogen peroxide, organic peroxide, hydroperoxide, and azonitrile. Examples of peroxides which can be used include hydrogen peroxide, methyl hydroperoxide, tert-butyl hydroperoxide, dimethyl peroxide, dibenzoyl peroxide, and the like.

The azonitrile compounds suitable for use as catalysts have the formula $NC - R'' - N = N - R'' - CN$ wherein each R'' is an alkylene or substituted alkylene group. Substituents on the alkylene group can be aryl, cycloalkyl, carboxy, or other. Each R'' preferably contains from 4 to 20 carbon atoms.

Of the azonitrile compounds which are suitable for use as catalysts in my invention, the symmetrical compounds having each of the azo nitrogens attached to a carbon atom to which are attached 3 other carbon atoms are preferred. Examples of these compounds include: alpha,alpha'-azodiisobutyronitrile, alpha,alpha'-azobis(alpha-ethylbutyronitrile), and alpha,alpha'-azobis(alpha-cyclohexylpropionitrile).

It is desirable that the catalysts which are hydrocarbonaceous material being in a range of 1–20 carbon atoms per molecule and preferably in a range of about 1–10 carbon atoms per molecule.

The catalysts of the above-described type having greater than about 20 carbon atoms per molecule are undesirable owing to the fact that they are not sufficiently active.

The petroleum fraction of a mixture having a reduced sulfur concentration is thereafter separated from the polymer having the alkyl sulfides associated therewith. This separation step can be conducted by many methods known in the art such as for example, extractive distillation, filtration, centrifuge, flashing, etc.

Various promoters known in the art can also be added to the mixture prior to subjecting the mixture to the light waves or catalysts for effecting a decrease of reaction time. In particular, trialkyl phosphites having the general formula $(RO)_3P$ are used as promoters wherein R is a 1–10 carbon alkyl and preferably where each R is the same alkyl radical having 1 to 5 carbon atoms.

Representative phosphites which can be employed as promoters in the present invention include trimethyl phosphite, tri-n-butyl phosphite, tri-n-decyl phosphite, and the like. Also, triaryl phosphites $(ArO)_3P$ where Ar is an aryl or alkaryl having 6 to 10 carbon atoms may be used as promoters. Representative aryl phosphites which may be used as promoters in this invention include triphenyl phosphite, tritolyl phosphite, trixylyl phosphite, trinaphthyl phosphite and tributylphenyl phosphite.

It has also been found that the method of this invention can be effectively conducted at about ambient conditions of pressures and temperatures as opposed to heretofore utilized methods which require elevated temperatures and pressures.

In tests conducted in the method of this invention, a gasoline having a bromine number of 0.91, a sulfur content of 0.318 weight percent, a 0.292 weight percent mercaptan, a specific gravity at 60/60 of 0.6692 and a Sour Doctor test was utilized in the following examples:

EXAMPLE I

A 2,000 milliliter sample of the gasoline was irradiated with light waves from a 200 watt ultraviolet Hanovia light source for 3 hours at room temperature. The mercaptan sulfur at the initiation of the test was 0.292 weight percent and was 0.245 weight percent at the conclusion of the test.

EXAMPLE II

The end product of Example I was thereafter mixed with 15 grams of liquid polybutadiene having an average molecular weight of about 1000–3000 and irradiated for 4 hours at room temperature. The mercaptan sulfur was further decreased to 0.216 weight percent by the end of this 4 hour period.

EXAMPLE III

The end product of Example II was thereafter mixed with 21 milliliters of trimethylphosphite and thereafter irradiated for 6 hours. At the end of this period, the mercaptan sulfur was further reduced to 0.000 weight percent. The gasoline was flashed, the polymer residue left as a kettle product, and had a total sulfur content of 4.10 weight percent and the flashed gasoline had a sulfur content of 0.14 weight percent in the form of sulfide.

EXAMPLE IV

Another 2,000 milliliter sample of the gasoline was mixed with 20 grams of liquid polybutadiene having an average molecular weight of about 1000–3000 and 10 grams of trimethylphosphite and thereafter irradiated with the above cited 200 watt ultraviolet light source at room temperature, which reduced the mercaptan sulfur content at the end of a 6 hour period from 0.241 weight percent to a value of 0.007 weight percent and the flashed gasoline to a value of 0.15 weight percent total sulfur in the form of sulfide. The gasoline was flashed by heating to vaporize the gasoline.

These examples show that the sulfur content of a gasoline having mercaptans can be significantly reduced by mixing a volume of polybutadiene with the gasoline, irradiating the resultant mixture, and thereafter separating gasoline from the polymer.

EXAMPLE V 1000 ml of Soltrol 100* was placed in a liter graduate. To this was added 10 ml of n-butyl mercaptan, 10 g. of liquid polybutadiene having an average molecular weight of 1000–3000 and 5 g. azobis-isobutyronitrile. The mixture was then heated with an infrared lamp to 150° to 160°F. and held at this temperature throughout the tests. The following data and observations were taken:

| Temp. | Hours | Mercaptan Sulfur, Wt. % | Observations |
|---|---|---|---|
| 152 | 0 | 0.389 | Start of test. |
| 160 | 2 | 0.338 | |
| 160 | 21 | 0.151 | A resinous precipitate was observed at this point. |
| 155 | 94 | 0.0309 | |
| — | 286 | 0.0037 | Shutdown. |

*Soltrol 100 is a trademark for 100% isoparaffinic hydrocarbons with a boiling range of 310°–345°F.

By the end of the test it was apparent that most of the polybutadiene had precipitated from the solution. A portion of the precipitated polymer was recovered from the graduate, dried, and analyzed for sulfur content. A sample of the starting polybutadiene was also analyzed for sulfur with results as follows:

| | Sulfur, Wt. % |
|---|---|
| Polybutadiene used in tests | 0.05 |
| Resinous polymer recovered from graduate | 7.20 |

A sample of the Soltrol was decanted from the polymer and analyzed for total sulfur. Another sample was flash distilled to remove any polymer remaining in solution, then analyzed for total sulfur with the following results:

| | Total Sulfur, Wt. % |
|---|---|
| Soltrol 100 decanted from polymer | 0.003 |
| Soltrol 100 flashed to remove polymer in solution | 0.001 |

The starting Soltrol 100 contained 2-3 ppm sulfur.

Other modifications and alterations of this invention will become apparent to those skilled in the art from the foregoing discussion and examples, and it should be understood that this invention is not to be unduly limited thereto.

I claim:

1. A method for reducing the sulfur content of a petroleum fraction having a distillation end point below about 600°F. and containing mercaptans, comprising:

contacting the liquid petroleum fraction with at least one compound selected from the group consisting of a polymer of a conjugated diene, a copolymer of a conjugated diene, a copolymer of a conjugated diene with a vinyl aromatic compound, such as to form a resultant mixture, said polymer having at least about 30 double bonds per molecule;

subjecting said resultant mixture to an ultraviolet light wave or an irradiation from a fluorescent light source; and separating the petroleum fraction from the polymer.

2. A method in accordance with claim 1 wherein the contacting polymer is in a liquid form and has a viscosity in the range of about 100–6000 Saybolt seconds at 100°F.

3. A method in accordance with claim 1 wherein the contacting polymer is polybutadiene and the liquid petroleum fraction is gasoline.

4. A method in accordance with claim 1 wherein the contacting polymer has an average molecular weight in the range of about 1000–3000.

5. A method in accordance with claim 1 wherein said resultant mixture is heated to a temperature in the range of about 150° to about 160°F.

6. A method in accordance with claim 1 wherein a promoter is added prior to the irradiation of said mixture to reduce the irradiating time.

7. A method in accordance with claim 6 wherein said promoter has the general formula $$(RO)_3P$$

wherein R is an alkyl radical having 1 to 10 carbon atoms or an aryl or alkaryl radical having 6 to 10 carbon atoms.

8. A method in accordance with claim 7 wherein said promoter is trimethylphosphite.

* * * * *